US009918594B2

(12) United States Patent
Robertson

(10) Patent No.: US 9,918,594 B2
(45) Date of Patent: Mar. 20, 2018

(54) TOWEL RACK

(71) Applicant: Alan J. Robertson, Los Angeles, CA (US)

(72) Inventor: Alan J. Robertson, Los Angeles, CA (US)

( * ) Notice: Subject to any disclaimer, the term of this patent is extended or adjusted under 35 U.S.C. 154(b) by 0 days.

(21) Appl. No.: 14/684,235

(22) Filed: Apr. 10, 2015

(65) Prior Publication Data

US 2015/0289729 A1 Oct. 15, 2015

Related U.S. Application Data

(60) Provisional application No. 61/978,089, filed on Apr. 10, 2014.

(51) Int. Cl.
*F26B 3/00* (2006.01)
*A47K 10/04* (2006.01)

(52) U.S. Cl.
CPC ..... *A47K 10/04* (2013.01)

(58) Field of Classification Search
CPC ..... F26B 3/00; F26B 3/28; F26B 7/00; F26B 5/00; F26B 5/12; A47K 10/00; A47K 10/10
USPC ..... 34/621, 202, 90; 248/205.3; 4/601
See application file for complete search history.

(56) References Cited

U.S. PATENT DOCUMENTS 1,681,614 A * 8/1928 Hubinger ..... A47K 10/025 211/106
1,734,532 A * 11/1929 Sacerdote ..... F24D 19/00 211/119.008
2,181,543 A * 11/1939 Bentz ..... A47K 10/04 211/119.011
2,198,584 A * 4/1940 Swably ..... D06F 57/12 211/106
2,655,268 A * 10/1953 Whaley ..... A47K 10/10 108/29
4,094,076 A * 6/1978 Baslow ..... D06F 59/02 219/521
4,279,397 A * 7/1981 Larsson ..... A47B 95/008 108/152
D265,445 S * 7/1982 Duggan ..... D6/549
4,372,449 A * 2/1983 Fink ..... D06F 57/12 211/106
5,007,182 A * 4/1991 Fishman ..... A47K 10/48 34/202
5,433,152 A * 7/1995 Henry ..... A47K 10/04 108/42
5,546,678 A * 8/1996 Dhaemers ..... D06F 58/10 34/224

(Continued)

FOREIGN PATENT DOCUMENTS

WO WO 2005094538 A2 * 10/2005 ..... F26B 5/045
WO WO 2005094538 A3 * 10/2006 ..... F26B 5/045

*Primary Examiner* — Stephen M Gravini
(74) *Attorney, Agent, or Firm* — JD Harriman

(57) ABSTRACT

The towel holder of the present system provides a wide bar section that separates the two halves of a towel placed on the holder. This allows greater air flow and space between the two sides of the towel, promoting faster drying, fresher smell, and shorter drying times between uses. The bar section in one embodiment is perforated or mesh so that the air flow to the portion of the towel contacting the rack center bar is increased, improving the drying time and increasing the likelihood that the entire towel will dry at approximately the same rate.

11 Claims, 6 Drawing Sheets

(56) References Cited

U.S. PATENT DOCUMENTS 5,642,462 A * 6/1997 Huff ..... A47K 10/06 211/105.1
5,725,111 A * 3/1998 Choi ..... D06F 57/12 211/104
5,852,879 A * 12/1998 Schumaier ..... A61L 2/07 34/218
5,857,263 A * 1/1999 Chan ..... A45D 20/12 34/97
5,921,410 A * 7/1999 Emery ..... A47B 43/00 108/42
6,257,425 B1 * 7/2001 Liu ..... A47K 10/04 211/105.1
6,672,552 B1 * 1/2004 Jao ..... A47B 47/00 248/251
6,698,602 B2 * 3/2004 Taylor ..... A47B 73/00 108/42
6,857,528 B2 * 2/2005 Klein ..... A47B 96/16 211/105.1
6,866,157 B2 * 3/2005 Shone ..... A47B 55/02 211/105.1
6,874,247 B1 * 4/2005 Hsu ..... F26B 9/003 219/242
7,383,643 B2 * 6/2008 Blankenship ..... F26B 5/045 34/406
7,770,305 B1 * 8/2010 Krauss ..... D06F 57/12 211/104
9,349,620 B2 * 5/2016 Kamata ..... H01L 21/67775
2009/0173704 A1 * 7/2009 Kotajarvi ..... A47K 10/04 211/88.04
2012/0187059 A1 * 7/2012 Sisto ..... A47B 55/02 211/45
2015/0226481 A1 * 8/2015 Marchiori ..... F26B 5/12 34/412
2015/0289729 A1 * 10/2015 Robertson ..... A47K 10/04 34/621
2016/0000273 A1 * 1/2016 Shah ..... A47K 3/28 4/601

* cited by examiner

TOWEL RACK

BACKGROUND OF THE SYSTEM

This patent application claims priority to U.S. Provisional Patent Application Ser. No. 61/978,089 filed on Apr. 10, 2014, which is incorporated by reference herein in its entirety.

After a bath towel is used, it is typically hung on a towel rack or holder to dry and be available for further use until it is to be laundered. Prior art towel racks and holders come in a number of configurations, including hooks, rings, pegs, and bars. All prior art towel racks and holders share a common disadvantage, namely that the towel is generally folded over, approximately in half, such that the two sides of the wet towel are either touching or in very close proximity. Towels may be folded over a rack so that that the towel extends its full width on the towel rack. In other instances, the towel may be bunched up through a ring or even folded in fourths to hang over the available space on a bar. Regardless of the hanging technique, the towel does not have sufficient separation from its two sides to permit full drying of the towel between uses.

Depending on the environment, the towel may not be fully dry by the next time it is to be used (often after approximately 24 hours). Even if the towel has dried between uses, it is often musty smelling and discourages repeated uses. In that situation, a person may change towels every day, wasting water and negatively affecting the environment.

The problem becomes worse with hand towels and dish towels that are used more often than every 24 hours, in some cases multiple times per day. Prior art towel holders where hand towels are used, such as the kitchen, often consist of a drawer handle where the towel stays damp and musty after its first use.

In some prior art embodiments, heated towel racks are provided that aid in drying the towel between uses. A disadvantage of heated towel racks is the expense and energy wasted during use.

SUMMARY

The towel holder of the present system provides a wide bar section that separates the two sides of a towel placed on the holder. This allows greater air flow and space between the two sides of the towel, promoting faster drying, fresher smell, and shorter drying times between uses. The bar section in one embodiment is perforated or mesh so that the air flow to the portion of the towel contacting the rack center bar is increased, improving the drying time and increasing the likelihood that the entire towel will dry at approximately the same rate. The towel holder may be wall mounted, free standing, cantilevered, or any other suitable configuration that allows for separation of the surfaces of a towel when in use.

DETAILED DESCRIPTION OF THE SYSTEM

The towel holder of the present system comprises a center bar or platform suspended between two side members that can be attached to a surface, such as a wall or cabinet. In another embodiment, the towel holder can be a floor standing unit with one or more vertical legs supporting a bar or platform over which a towel is draped to provide a holding surface. The center bar or platform is relatively wide, such that there is sufficient space between the inner sides of a towel to allow air to pass more readily and naturally dry the towel that is disposed on the unit. This could be accomplished by various widths in order to allow sufficient air flow to pass between the inner sides of the towel. In addition, the center bar is ideally perforated or comprised of mesh such that air flow to the portion of the towel in contact with the bar is improved.

Figure 1:
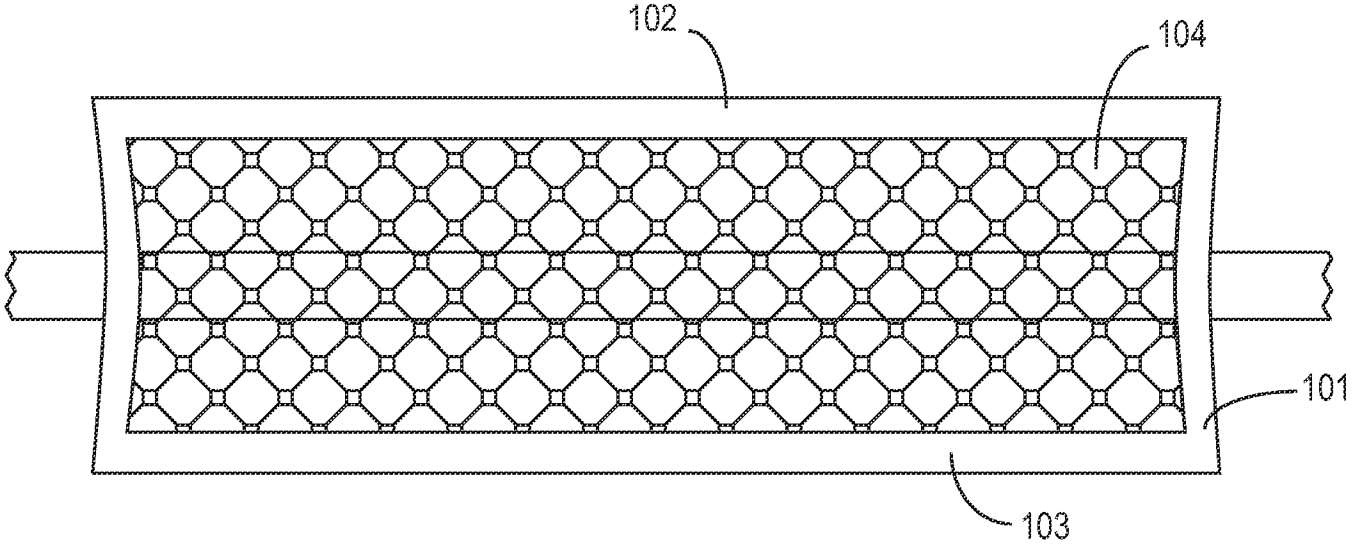
FIG. 1 illustrates an embodiment of a wall mounted embodiment.

FIG. 1 illustrates an embodiment of the towel rack of the present system. The towel holder comprises a center platform 101 that includes front 103 and back sides 102. The center platform 101 comprises in one embodiment a mesh 104 that allows airflow to the towel when the holder is in use. In this embodiment, the towel holder is wall mounted. In one embodiment, the towel holder is dimensioned such that the distance between back edge 102 of the center platform and an adjoining wall is at least as much as the width of the platform (e.g. the distance between front edge 103 and back 102 edges of the platform). This distance provides at least as much airflow between the wall and the towel as is provided between the halves of the towel when in use. In other embodiments, the back edge 102 can be closer to the wall if desired, due to the fact that the wall itself does not need to dry, so that less airflow may be sufficient to allow the towel to dry.

In one embodiment the mesh portion 104 of the towel rack is approximately 2-3 inches wide, allowing better air-flow than prior art systems. In other embodiments the mesh portion may be wider or thinner as desired so that there is sufficient separation between the halves of the towel in use. The length of the towel rack along its longest axis may be of any suitable length so that a towel may be spread over the rack without bunching or overlay. In one embodiment the rack is 18-36 inches in length.

In one embodiment, the platform is comprised of metal. However, the platform can be comprised of any suitable rigid material, including plastic, wood, and the like, without departing from the scope and spirit of the system. In addition, instead of the mesh embodiment, the platform may be perforated, slotted, or otherwise provided with openings that allow airflow to the portion of the towel overlaying the platform. In one embodiment, the platform may be solid as well.

Figure 2:
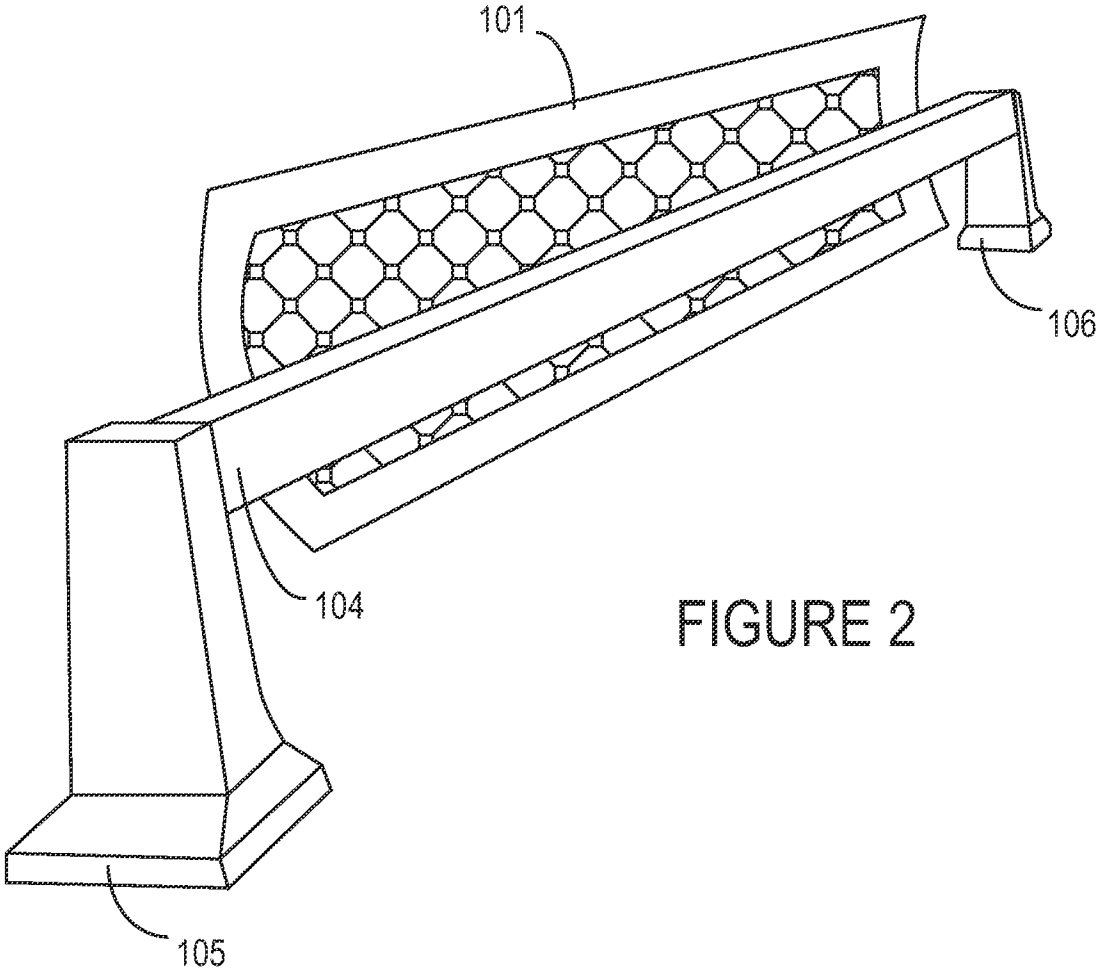
FIG. 2 is another view of the embodiment of FIG. 1.

FIG. 2 illustrates another view of the system. In this embodiment, the rack 101 may be retrofitted to an existing towel rack 105. The view in FIG. 2 is from below where the existing rack 104 is attached to a wall. As a retrofit, there can be any one of several ways of attaching the center platform 101 to an existing, more narrow towel rack. The platform 101 may be affixed to an existing rack 104 using any suitable means of fastening, such as adhesives, screws, straps, zip ties, and the like. As can be seen, the platform existing rack 104 is attached to a wall or other surface by side members 105 and 106. The system of FIG. 2 may be originally built as a unit or it may be a retrofit to an existing towel rack that has its own prior art cross bar such as bar 104.

Figure 5A:
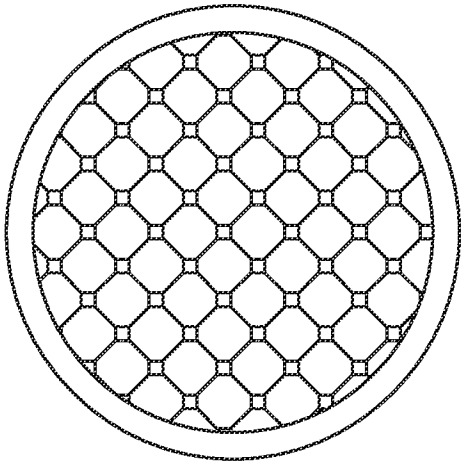
FIGS. 5A-5C illustrate embodiments of the platform.
Figure 5B:
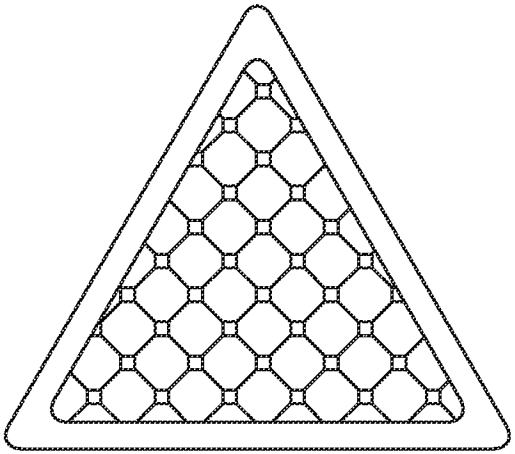
Figure 5C:
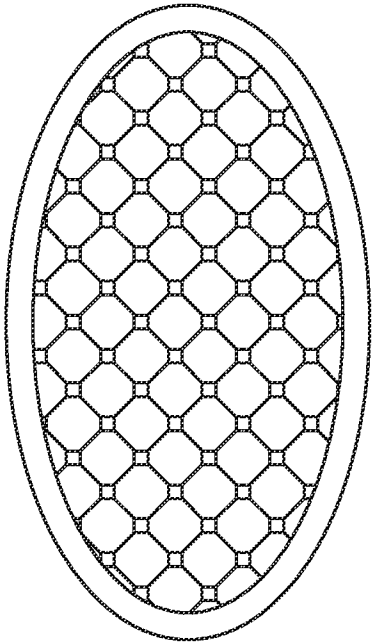
Figure 6:
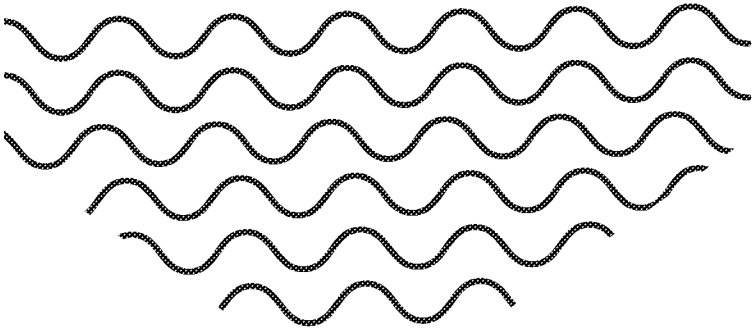
FIG. 6 illustrates an example of a three dimensional mesh embodiment.

The center platform 101 of the system may be substantially flat or slightly curved as shown in FIG. 2. Although shown as a rectilinear shape in the Figures, the shape of the platform may be any suitable shape, including oval, circular, triangular, and the like as illustrated in FIGS. 5A-5C. In another embodiment, the platform 101 may have a three dimensional surface with peaks and valleys to provide additional airflow to the towel material as shown in FIG. 6.

Figure 3:
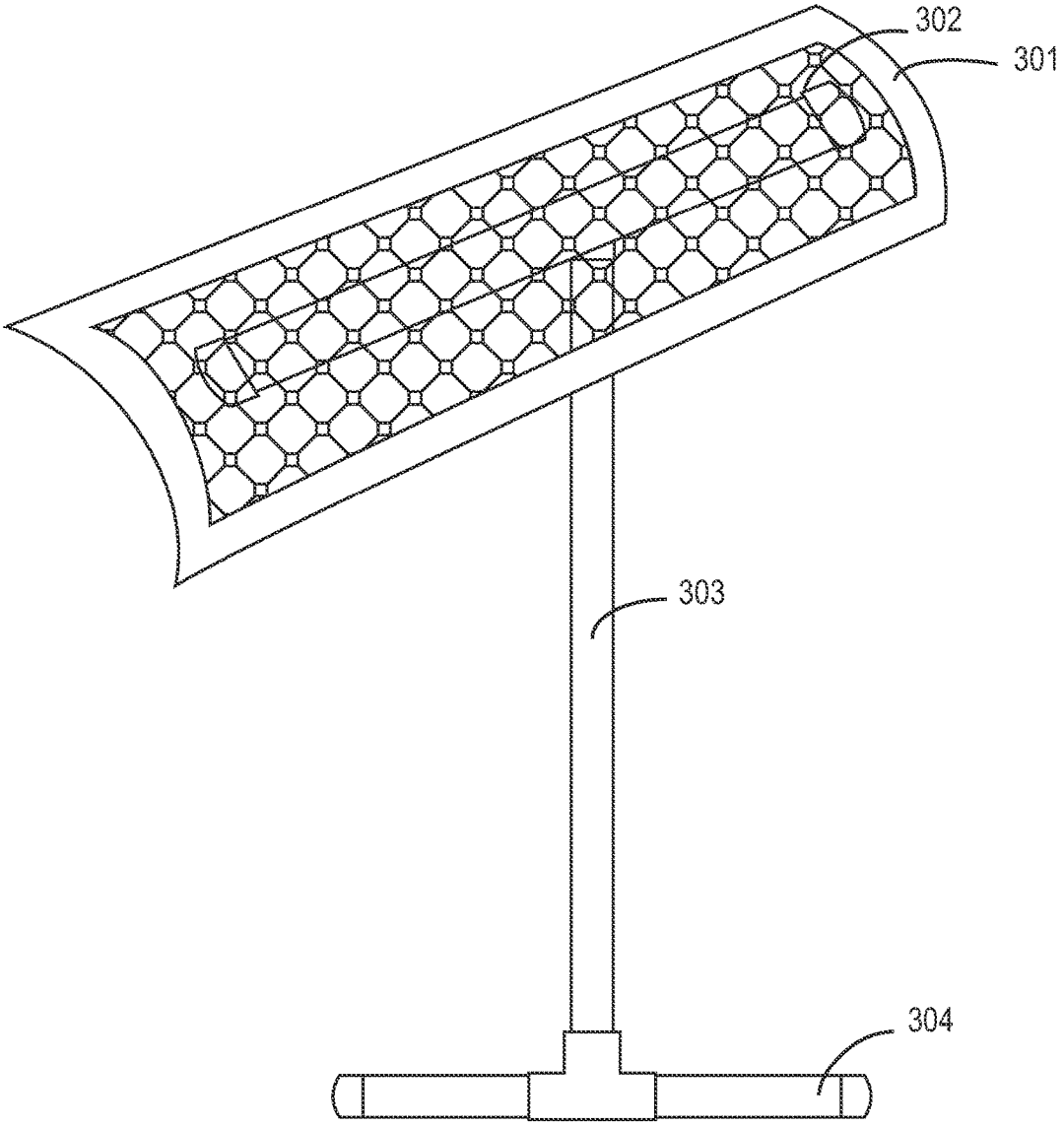
FIG. 3 illustrates a free standing embodiment.

An alternate embodiment of the system is illustrated in FIG. 3. In this embodiment, the towel rack is free standing on the floor, making it useful to use anywhere it is needed without permanently affixing it to a wall or surface. The embodiment of FIG. 3 includes a support member 302 for holding the center platform 301. The support member 302 is coupled to legs 303 that elevate the platform 301 off the floor sufficiently to allow a large towel to be draped over the unit for drying. A free standing embodiment may have a circular drying platform that allows the towel to be draped over the unit, with some gap between the floor and the bottom of the towel to allow airflow for drying. In another embodiment, the drying platform may be rectilinear, triangular, or any other suitable shape to allow support of the towel without sides of the towel touching or being too close for sufficient airflow.

Figure 4:
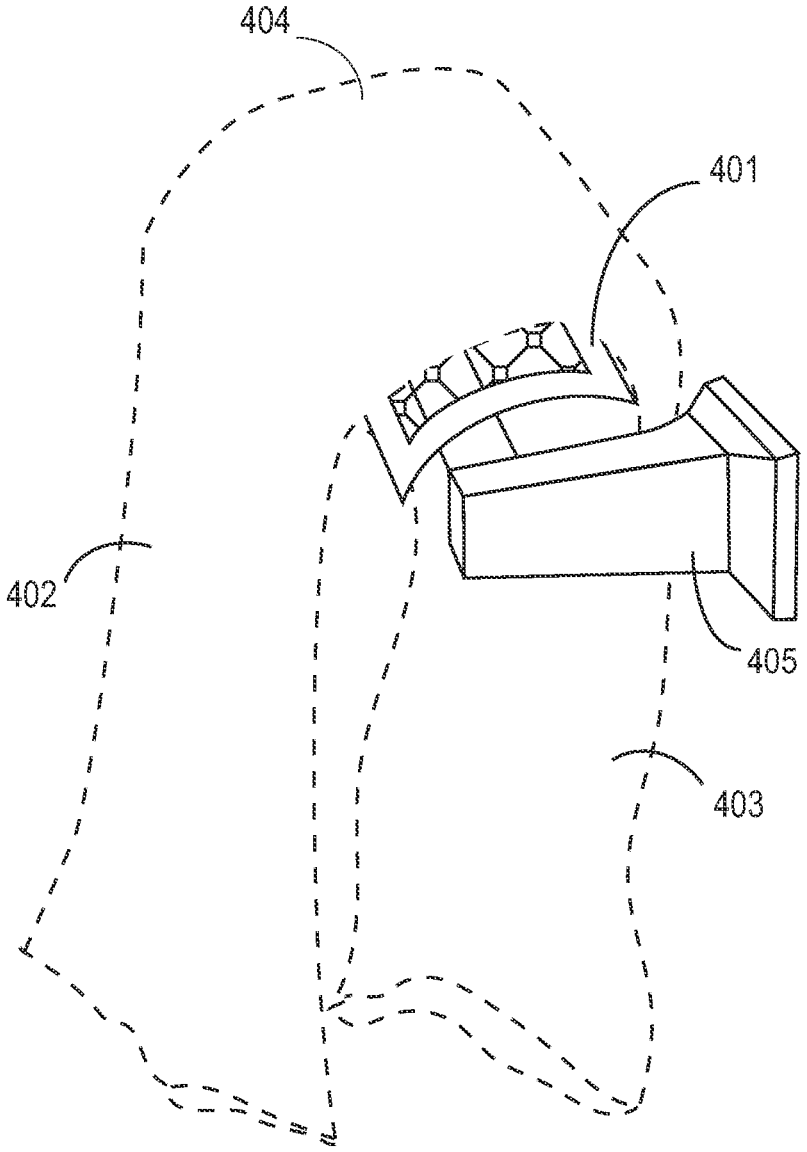
FIG. 4 illustrates a side view of the system in use.

FIG. 4 illustrates the system when in use. The towel 401 is draped over the center platform 401 so that left side 402 and right side 403 are separated by an open air space. The section 404 of the towel over the platform is exposed to air via the mesh or perforations of the center platform.

Although the embodiments herein illustrate the center platform as an elongated rectangle, it should be understood that the platform may be implemented in any number of shapes, either free-standing or wall mounted. For example, the center platform may be round, square, triangular, curved, flat, concave, convex, or anHy other suitable shape that supports a towel while providing sufficient space for airflow between sections of the overhanging towel.

In addition, although the system is described in connection with a towel, the towel may be a bath towel, hand towel, face towel or the like. The system may also be used for any material that is typically hung for drying, including chamois clothes, wipes, sheets, pillow cases, rags, clothing, and the like.

What is claimed is:

1. A towel rack for drying a towel comprising:

a platform for receiving and drying the towel, the platform comprising an elongated horizontal rectangle having a curved shape in cross-section and a mesh surface thereon for receiving the towel; the mesh surface of the platform having a plurality of openings formed therein for allowing airflow through the platform for drying the towel and wherein the platform has a width sufficient to allow the towel to be draped over the platform without sides of the towel touching.

2. The towel rack of claim 1 wherein the platform comprises a mesh material.

3. The towel rack of claim 1 wherein the platform has a plurality of holes formed therein.

4. The towel rack of claim 1 wherein the platform has plurality of slots formed therein.

5. The towel rack of claim 1 further including a support means wherein the support means is mounted to a wall and supports the platform adjacent to and away from the wall.

6. The towel rack of claim 1 further including a support means wherein the support means is free standing on a surface and supports the platform above the surface.

7. The towel rack of claim 1 wherein the platform is rectilinear.

8. The towel rack of claim 1 wherein the platform is oval.

9. The towel rack of claim 1 wherein the platform is circular.

10. The towel rack of claim 1 wherein the platform is triangular.

11. The towel rack of claim 1 wherein the platform has a three dimensional surface with peaks and valleys.

* * * * *